United States Patent [19]

Hoffmann

[11] Patent Number: 4,519,868

[45] Date of Patent: May 28, 1985

[54] COMPUTER CONTROLLED LABELLING MACHINE

[76] Inventor: Wolfgang Hoffmann, 3420 Saginaw Ct., Modesto, Calif. 95355

[21] Appl. No.: 441,040

[22] Filed: Nov. 12, 1982

[51] Int. Cl.[3] ..... G03D 15/04; B26D 5/34

[52] U.S. Cl. ..... 156/353; 83/371; 226/27; 226/28; 156/361

[58] Field of Search ..... 156/361, 353, 354; 226/27, 28, 30, 31; 53/51; 83/371

[56] References Cited

U.S. PATENT DOCUMENTS

| | | | |
|---|---|---|---|
| 3,601,587 | 8/1971 | Thiede | 226/28 X |
| 4,221,144 | 9/1980 | Diesch et al. | 83/371 X |
| 4,264,957 | 4/1981 | Dautzke | 226/28 X |
| 4,316,566 | 2/1982 | Arleth et al. | 226/28 X |
| 4,361,260 | 11/1982 | Hanlan | 226/30 |

*Primary Examiner*—David Simmons

[57] ABSTRACT

A system (50) includes a labelling machine (52) and a digital data processing system (54) connected to the labelling machine (52). A cutter (56) of the labelling machine (52) has a shaft (58) with a mark (60), which is sensed by a sensor (62). The sensor (62) supplies shaft (58) information on line (3) to digital data processing system (54). The digital data processing system (54) supplies control signals on line (64) to feed roll (66) stepper motor (67). The digital data processing means (54) is also connected to an optical sensor (76) by line (78). The optical sensor (76) senses the position of position mark (74) on the labels (70), which is correlated with the position of shaft (58) in order to feed the labels (70) to the cutter (56) at the proper rate so that the labels (70) are always cut at the kerf (72) between each label (70).

4 Claims, 2 Drawing Figures

COMPUTER CONTROLLED LABELLING MACHINE

BACKGROUND OF THE INVENTION

1. Field of the Invention

This invention relates to a labelling machine which is controlled by a digital data processing system. More particularly, it relates to such a system in which mechanical camming mechanisms and similar components of a conventional labelling machine are replaced by electronic controls embodied in a digital data processing system connected to control tuning, feed and related operations of a labelling machine of the type which is able to apply labels of various sizes to packaging containers of various sizes.

2. Description of the Prior Art

In conventional machines used to apply different size labels to different size cans, glass bottles, boxes or other packaging containers, timing marks, cams, gears and similar interconnected mechanical elements are employed to assure that the containers and labels are supplied to the machine in an orderly fashion and syncronously with respect to each other so that a single label is uniformly placed in a desired location on the container. Some control functions of labelling machines have also been implemented with digital circuits, including microprocessors.

It is also known in the prior art to replace various mechanical timing devices in complex machines, such as internal combusion engines with digital electronics. Many such timing mechanisms have been replaced in automobile engines through the use of digital data processing circuits embodied in microprocessor integrated circuits, in combination with various electronic and electromechanical sensing circuits.

However, labelling machines are very complex devices with many unique problems. Hitherto, it has not been known in the art to replace the mechanical control systems for main drive shafts used in labelling machines with digital data processing and electrical sensing circuits. Examples of such labelling machines are described, for example, in the following commonly assigned issued patents and pending patent applications: U.S. Pat. Nos. 3,765,991; 4,108,709; 4,181,555; 4,188,843; 4,242,167; 4,336,095; and application Ser. No. 783,285.

SUMMARY OF THE INVENTION

Accordingly, it is an object of this invention to adapt digital data processing technology to a labelling machine.

It is another object of the invention to provide a digital data processing system in which electrical circuits are utilized to provide inputs representing positions and other information about the various components of a labelling machine and the labels and containers passing through the machine.

It is another object of the invention to provide such a labelling machine system for continuous roll label feeding.

It is still another object of the invention to provide a labelling machine in which labels are continuously fed as long as there are containers being fed through the machine to receive labels.

It is yet another object of the invention to provide such a labelling machine which is responsive to scanning marks placed on the kerf areas of labels as an aid in positioning the label properly with respect to a container.

The attainment of the foregoing and related objects may be achieved through use of the novel labelling machine and labelling machine system herein disclosed. The system of this invention includes a labelling machine and digital data processing means operatively coupled to the labelling machine. At least one sensing circuit is connected to supply input signals obtained from an operation of the labelling machine as an input to the digital data processing means. In a preferred form of the invention, a stepping motor used to advance the label in the machine is directed by a program in the digital data processing means to advance the label. The stepper motor is directed by the program to make a predetermined number of steps per machine cycle or per container. An encoder is also preferably connected to the data processing means so that a rate of the stepping motor is supplied as an input to the digital data processing means. The digital data processing means is also preferably connected to allow a user of the system to enter a particular label length as an input. The program of the digital data processing means then receives the other parameters supplied by the sensing circuits and operates the labelling machine to feed that size label to containers passing through the machine. The ability of the user to select any desired label length and have the machine operate properly for that length label without any mechanical adjustments to the labelling machine means that changing labels in the labelling machine is reduced from an operation taking 30 minutes or so to about 30 seconds.

The attainment of the foregoing and related objects, advantages and features of the invention should be more readily apparent to those skilled in the art, after review of the following more-detailed description of the invention, taken together with the drawings, in which:

DETAILED DESCRIPTION OF THE INVENTION

Figure 1:
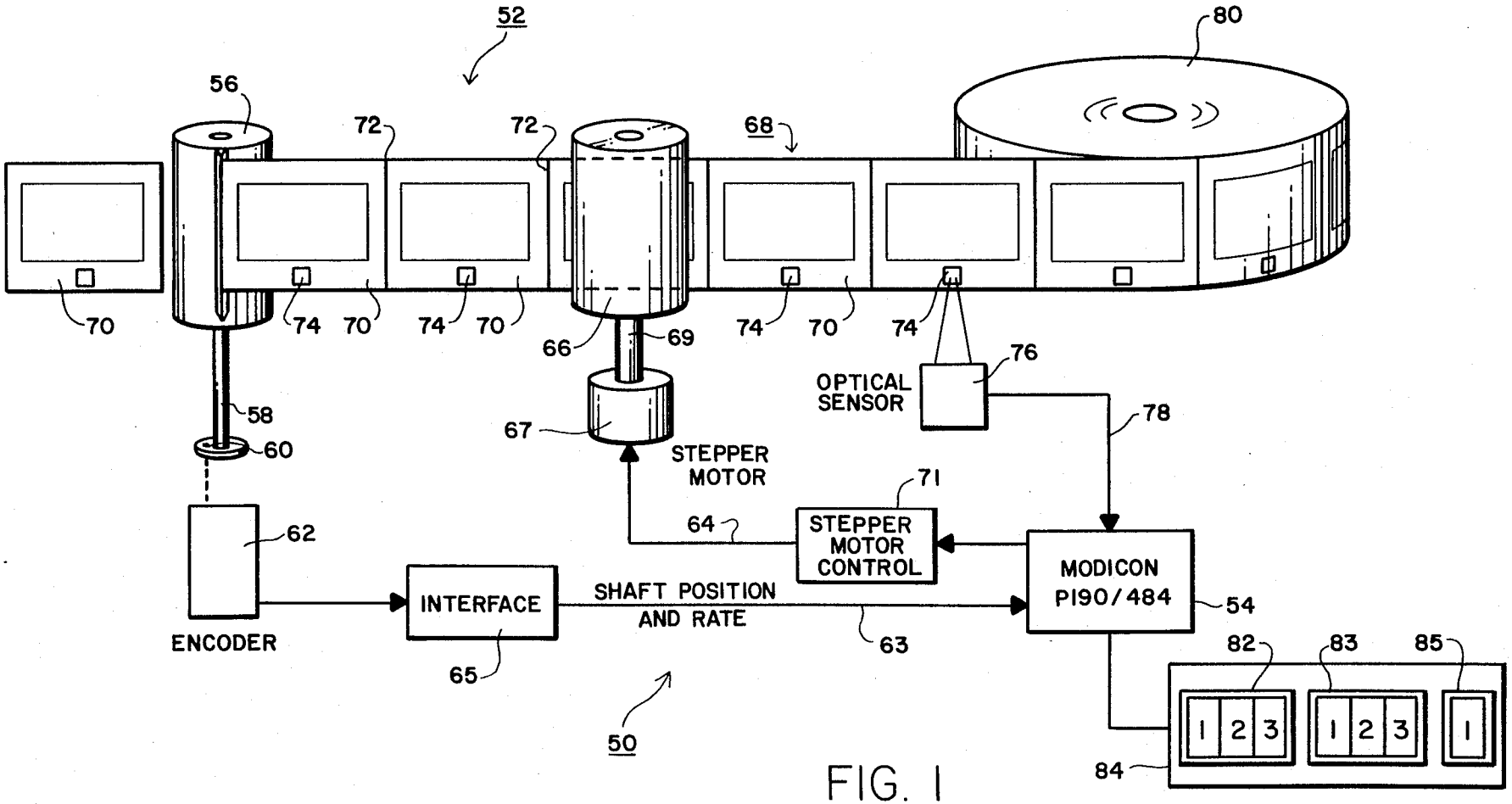
FIG. 1 is a block diagram of a computer controlled labelling machine in accordance with the invention.

Turning now to the drawings, more particularly to FIG. 1, there is shown a system 50 in accordance with the invention. The system 50 includes a labelling machine 52 and a digital data processing system 54. The digital data processing system 54 is implemented in this embodiment with a Gould Modicon-P190/484, although it should be understood that the digital data processing system 54 could be implemented with any one of a large number of commercially available control oriented data processing systems which, for example, utilize commercially available microprocessor integrated circuits, such as an Intel 8086, Intel 8088, Motorola 68000, Fairchild 9445, National Semiconductor 16000, or the like, to form the processing unit of such control oriented data processing systems.

The labelling machine 52 includes a cutter 56 having a shaft 58 including a mark 60, which is sensed by an encoder 62, which supplies shaft 58 position and rotation rate data signals as inputs to the digital data processing system 54 on line 63, through an interface 65. The encoder 62 could be replaced with any suitable sensor, such as a magnetic sensing means, with a structure of the shaft 58 serving the function of the mark 60 by perturbing a magnetic field to which the magnetic sensing means is responsive. In practice, the encoder 62 is preferably implemented with a C and A Model HT-11B encoder, obtainable from C and A Products. The interface 65 is preferably implemented with a PCEF Encoder Interface Module, which converts the shaft 58 position and rate information to binary coded decimal (BCD) form. The digital data processing system 54 supplies a rotation rate control signal at a rate of, for example, 2,000 pulses per revolution of a label-feed roll 66 on line 64 to a stepping motor 67, which is connected to feed roll 66 by a shaft 69, through a stepping motor control 71. The rotation rate control signal on line 64 is such that the feed roll 66 will supply continuous label sheet 68 to the cutter at a proper rate so that the cutter 56 will separate an individual label 70 from the sheet 68 at the kerf 72 dividing each individual label from its next adjacent neighbors.

Each label 70 includes a positioning mark 74. The positioning mark 74 is sensed by an optical sensor 76 as a means of preventing the sheet 68 from "creeping" with respect to the cutter 56, so that the cutter 56 begins to slit the sheet 68 at other locations than the kerf 72. The optical sensor 76 is connected to the data processing system 54 by line 78. The optical sensor 76 supplies a signal on line 76 when a mark 74 is sensed. The digital data processing system 54 compares the shaft 58 at the time the mark 74 is sensed with the position shaft 58 should have in order for label 70 feed and shaft 58 position to be synchronized for proper label 70 slitting. The optical sensor 76 is preferably implemented with a Banner CVG-1 sensor, obtainable from Banner, Inc., Minneapolis, Minnesota.

When it is desired to replace a roll 80 of the labels 70 with a roll of labels having a different length than that of the labels 70, the length of the new labels in inches is entered into the digital data processing system 54 by means of thumbwheel switches 82 on the front panel 84. An angular position in degrees for shaft 58 when a mark 74 should be sensed by sensor 76 is dialed in with thumbwheel switches 83. A tolerance for the angular position in degrees in also entered by means of thumbwheel switch 85.

Figure 2:
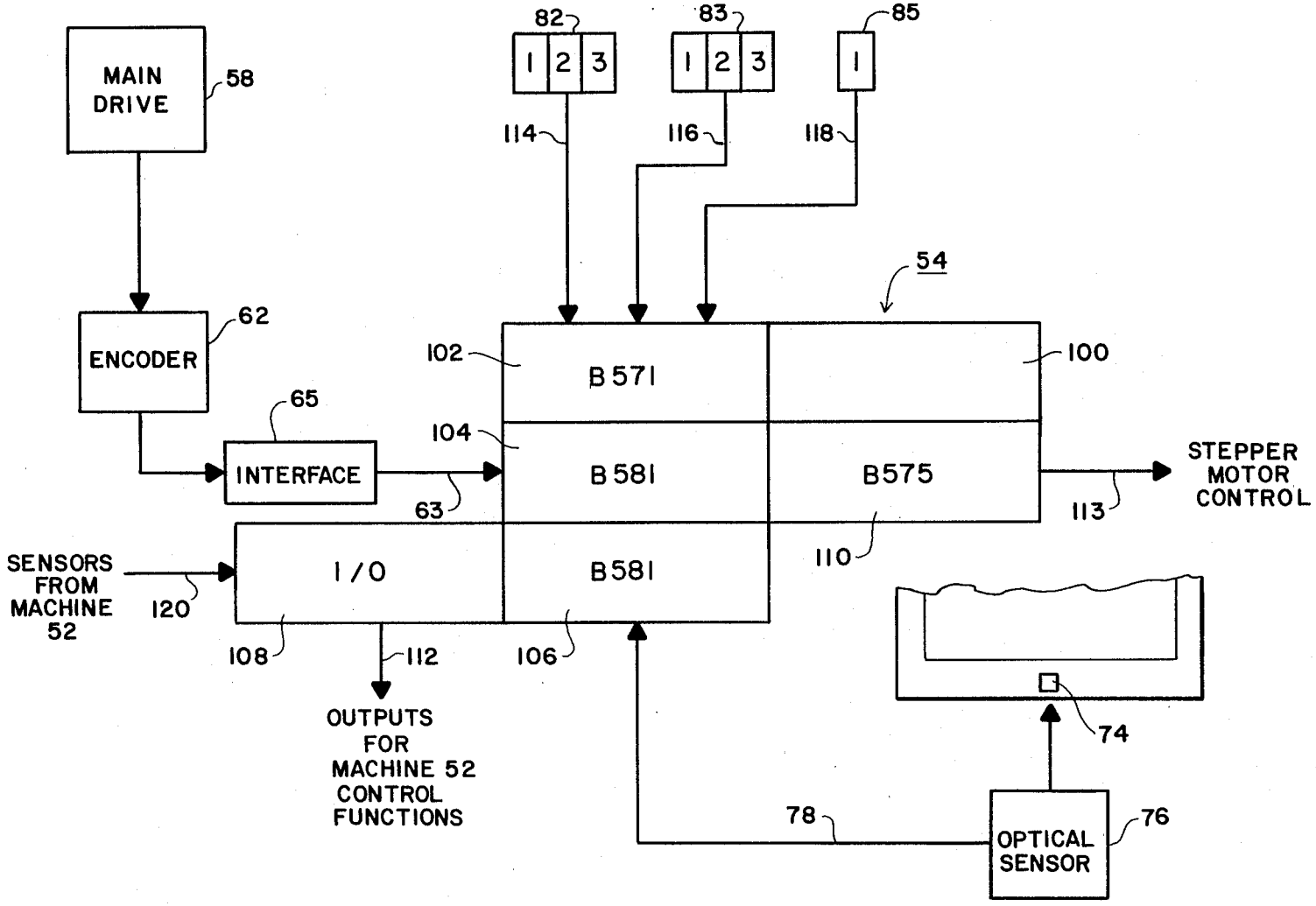
FIG. 2 is a plan view of a portion of the system shown in FIG. 1.

FIG. 2 shows the data processing system 54 in the system of FIG. 1 in more detail.

The system 54 includes a processor 100. Input modules 102, 104, and 106 are connected to supply input to the processor 100. An input/output module 108 is also connected to supply inputs to the processor 100 and supply outputs from the system 54 on line 112 for certain machine control functions conventional in the art and not forming a part of this invention. However, these other control functions are provided using the same data processing system 54 used for the rest of the invention. An output module 110 is connected to receive outputs from the processor 100, to be supplied to the stepper motor control on line 113.

Interface module 65 is connected to the input module 104 of data processing system 54 by line 63. The thumbwheel switches 82, 83, and 85 are respectively connected to the input multiplexer module 102 by lines 114, 116, and 118. Inputs from other sensors attached to the labelling machine 52 (see also FIG. 1) are supplied on line 120 to the I/O module 108. Outputs for labelling machine 52 control functions are supplied by the I/O module 108 on line 112. Optical sensor 76 supplies the input signal to input module 106 on line 78 when it senses the presence of a registration mark 74.

Attached as an appendix to this specification is a machine language program listing of a suitable control program for the Modicon-P190/484 digital data processing system 54.

It should now be readily apparent to those skilled in the art that a novel digital data processing system controlled labelling machine capable of achieving the stated objects of the invention has been provided. The system 50 feeds labels 70 from roll 80 on a continuous basis to the cutter 56 in such a manner that the cutter will cut the labels 70 at the kerf 72 and supply the cut labels 70 to a container in a consistent manner. Changing the label machine 52 to accommodate different size labels is a simple matter of entering the new label length into the digital data processing system 54.

It should further be apparent to those skilled in the art that various changes in form and detail of the invention as shown and described may be made. For example, the mark 74 can be placed on any desired location on the label. It is intended that such changes be included within the spirit and scope of the claims appended hereto.

What is claimed is:

1. In combination, a digital data processing means, a labelling machine including a master shaft and a slave shaft, means for sensing position of said master shaft of said labelling machine operatively connected between said master shaft and said digital data processing means, an optical sensor for a registration mark for each label on a sheet of labels, said optical sensor being connected to said digital data processing means, a means for entering a length of labels on the sheet to be fed through said labelling machine, said length entering means being connected to said digital data processing means, a drive roller positioned to advance the sheet of labels in said labelling machine, a stepping motor connected between said drive roller and said digital data processing means, said digital data processing means including means responsive to inputs from said master shaft position sensing means, said registration mark optical sensor and said length entering means for providing actuating signals from the master shaft position, sensed registration mark and length inputs to said stepping motor to maintain alignment of each label in the sheet of labels relative to position of the master shaft as the sheet of labels is advanced in said labelling machine.

2. The combination of claim 1 in which said master shaft is fixedly connected relative to a cutter of said labelling machine.

3. In combination, an electronically controlled differential comprising a master shaft for carrying out a repetitive operation at regularly spaced intervals on a workpiece advanced relative to said master shaft and a slave shaft positioned to advance the workpiece relative to said master shaft, means for sensing position of said master shaft, an optical sensor for registration marks at the regularly spaced intervals on the workpiece, a stepping motor connected to said slave shaft, electronic circuit means operatively connected to receive data from said master shaft position sensing means and said registration mark optical sensor, an input means connected to said electronic circuit means to supply a user selectable interval between registration marks on the workpiece, said electronic circuit means being connected to supply actuating signals to said stepping motor based on the data from said master shaft sensing means and said registration mark optical sensor and the user selected interval to control operation of said slave shaft relative to said master shaft.

4. The combination of claim 3 in which said electronic circuit means is a digital data processing means.

* * * * *